US007325523B2

(12) United States Patent
Sailer et al.

(10) Patent No.: US 7,325,523 B2
(45) Date of Patent: Feb. 5, 2008

(54) VALVE TIMING GEAR OF AN INTERNAL COMBUSTION ENGINE

(75) Inventors: Peter Sailer, Erlangen (DE); Oliver Schnell, Veitsbronn (DE)

(73) Assignee: Schaeffer KG, Herzogenaurach (DE)

( * ) Notice: Subject to any disclaimer, the term of this patent is extended or adjusted under 35 U.S.C. 154(b) by 0 days.

(21) Appl. No.: 11/615,099

(22) Filed: Dec. 22, 2006

(65) Prior Publication Data

US 2007/0144467 A1 Jun. 28, 2007

(51) Int. Cl.
*F01L 1/04* (2006.01)

(52) U.S. Cl. ..... 123/90.52; 123/90.44; 123/90.45

(58) Field of Classification Search ..... 123/90.39, 123/90.44, 90.45, 90.46, 90.48, 90.52, 90.55
See application file for complete search history.

(56) References Cited

U.S. PATENT DOCUMENTS 5,622,147 A * 4/1997 Edelmayer ..... 123/90.35

FOREIGN PATENT DOCUMENTS

| | | | |
|---|---|---|---|
| DE | 42 01 618 | A | 7/1993 |
| DE | 196 30 443 | Y | 1/1998 |
| DE | 196 53 459 | Y | 6/1998 |
| DE | 197 10 577 | Y | 9/1998 |
| DE | 198 02 738 | A | 7/1999 |
| DE | 198 18 146 | Y | 10/1999 |
| DE | 199 02 445 | A | 7/2000 |
| EP | 16 07 587 | Y | 12/2005 |

* cited by examiner

*Primary Examiner*—Ching Chang
(74) *Attorney, Agent, or Firm*—Lucas & Mercanti, LLP

(57) ABSTRACT

In a valve timing gear of an internal combustion engine having hydraulic valve clearance adjusting elements (21), each element (21) comprises a rotationally symmetrical housing (22), which is guided so that it is longitudinally displaceable in a seat in the engine and at one axial end of the element (21) is acted upon by a cam of a camshaft. The element (21) comprises a piston (24) which is axially displaceable in the housing (22) and is non-positively connected either directly or indirectly to an engine gas exchange valve. A control valve (31), which has a closing member (39) and a valve seat for this formed on the piston (24), is arranged axially between the housing (22) and the piston (24). A reverse-spring element is used as valve clearance adjusting element (21), that is to say an element the control valve (31) of which comprises a control valve spring (30), which is supported by one end on the piston (24) and by the other end on the closing member (39).

2 Claims, 2 Drawing Sheets

VALVE TIMING GEAR OF AN INTERNAL COMBUSTION ENGINE

FIELD OF THE INVENTION

The invention relates to a valve timing gear of an internal combustion engine having hydraulic valve clearance adjusting elements, in which each element comprises a rotationally symmetrical housing, which is guided so that it is longitudinally displaceable in a seat in the engine and at one axial end of the element is acted upon by a cam of a camshaft, the contact surface of the cam having dimensional tolerances which give rise to a base circle eccentricity in a peripheral direction and which are determined by positive and negative dimensional deviations in the radial dimension of the contact surface, and the element comprising a piston, axially displaceable in the housing, and being non-positively connected by way of this piston or the housing, either directly or via further valve train components provided with contact surfaces, to an engine gas exchange valve, a control valve, which has a closing member and a valve seat for this formed on the piston, being arranged axially between the housing and the piston.

BACKGROUND OF THE INVENTION

Hydraulic valve clearance adjusting elements serve to adjust the clearance which, in transmitting the cam lift of a camshaft to a gas exchange valve of the internal combustion engine, is formed between the transmission elements due to wear or thermal expansion. The intention in using the adjusting element is to achieve a quiet and wear-resistant operation of the valve train and the greatest possible conformity between the cam lobe and the lift of the gas exchange valve.

Such adjusting elements in each case have a control valve embodied as a non-return valve, which has a closing member, such as a ball, and a control valve spring, which acts upon the closing member. In the standard type of control valve the control valve spring acts upon the closing member in the closing direction. This largely closes the control valve so that there is no idle travel of the valve clearance adjusting element. In this embodiment there is a risk of pumping up the adjusting element, producing a "negative valve clearance". DE 198 44 202 A1 demonstrates a valve timing gear of the aforementioned type, in which the valve clearance adjusting element is embodied as an adjustable circular-cylindrical cam follower. As can be seen from the drawing, the control valve spring acts upon the closing member in the closing direction, so that the control valve is largely closed.

The disadvantages of known adjusting elements are avoided by control valves, the control valve spring of which acts upon the closing member in the opening direction, or in which a spring is entirely dispensed with. Adjusting elements having a control valve of this type are referred to as reverse-spring elements, owing to the inverse arrangement of the control valve spring, or in the absence of a spring as freeball elements.

These exert a positive influence on the thermodynamics, the pollutant emissions and the mechanical stressing of the internal combustion engine and are therefore being increasingly used.

Whereas in the standard design type the control valve is closed in the base circle area of the cam owing to the spring force of the control valve spring, with a reverse-spring element the control valve in this area is kept open by the force of the control valve spring, or in the case of a freeball element is not forcibly closed. Since such an element can only be closed by hydrodynamic and hydrostatic forces due to the flow of lubricating oil commencing at the beginning of the cam lobe and flowing from the high-pressure chamber to the low-pressure chamber, the element always has an idle travel before the valve lift of the gas exchange valve commences. The extent of the idle travel at any engine speed depends on the length of the control valve closing time and this in turn depends on the viscosity/density of the lubricating oil which, as is known, is used as hydraulic fluid.

To close the control valve of a reverse-spring/freeball element a so-called critical lubricating oil velocity is required. This varies as function of the lubricating oil viscosity and hence of the lubricating oil temperature. At high lubricating oil viscosity/density, that is to say at low lubricating oil temperatures, the critical lubricating oil velocity is lower and is therefore attained more rapidly than at low lubricating oil viscosity, that is to say high lubricating oil temperatures. In cold starting this leads to a shorter closing time of the control valve and hence to a smaller idle travel than in the engine at operating temperature. A small idle travel means a large valve overlap, however. This results in a large internal exhaust gas recirculation, which causes an uneven, low idling speed. Although this can be improved by increasing the idling speed, this is achieved at the expense of the pollutant emissions and the fuel consumption.

With reverse-spring/freeball elements the closing member of the control valve is therefore open in the base circle of the cam. To close the control valve, a volume flow must flow past the closing member, which causes a pressure differential on the closing member, with the result that the latter closes the control valve. Reverse-spring/freeball elements are disclosed, for example, by EP 1 298 287 A2, JP 61-185607 and U.S. Pat. No. 4,054,109. These demonstrate adjusting elements in each of which the control valve has a ball as closing member.

In conventional hydraulic valve clearance adjusting elements the control valve spring of the control valve embodied as a non-return valve is therefore arranged below the valve ball or the closing member and the piston forming the valve seat. At the start of the base circle phase of the camshaft cam, the control valve opens in order to replenish from the low-pressure chamber of the element that quantity of oil used as hydraulic medium, previously forced out of the high-pressure chamber of the element during the lifting phase, and in order to adjust an existing valve clearance through a corresponding fresh intake of oil into the high-pressure chamber of the element. Otherwise the control valve is closed during the base circle phase of the cam. The working of a conventional adjusting element imposes certain requirements on the design of the cam contacts.

Element-shortening base circle eccentricities in the conventional adjusting element can cause the engine or gas exchange valve to accidentally open in the base circle phase of the cam, which leads to corresponding mechanical and thermodynamic disadvantages.

Element-lengthening base circle eccentricities in the conventional adjusting element can cause the valve ball to open the non-return valve, so that the element draws oil from the low-pressure chamber into the high-pressure chamber. If this happens before the engine or gas exchange valve starts to lift, the control valve, opened owing to the intake, has first to close again before the cam lift can be transmitted to the gas exchange valve. The retarded function associated therewith produces an undesirable valve lift loss, which likewise leads to corresponding mechanical and thermodynamic disadvantages.

SUMMARY OF THE INVENTION

The object of the invention is to design the valve timing gear of an internal combustion engine so as to reduce the cost of manufacturing the components of the valve timing gear that come into contact and engagement with one another, without the resulting deviations in the dimensional tolerances of the component contact surfaces having a detrimental effect.

According to the invention this object is achieved in that a reverse-spring element is used as valve clearance adjusting element, that is to say an element the control valve of which comprises a control valve spring, which is supported by one end on the piston and by the other end on the closing member, and in that the dimensional tolerances of the contact surface of the cam in total exceed 25 μm.

In a further proposal, the object is achieved according to the invention in that a freeball element is used as valve clearance adjusting element, that is to say an element the control valve of which is designed without any control valve spring, and in that the dimensional tolerances of the contact surface of the cam in total exceed 25 μm.

In hydraulic valve clearance adjusting elements which are designed as reverse-spring elements or as freeball elements, their different construction means that the control valve is opened throughout the entire base circle phase of the cam. Element-shortening base circle eccentricities in this case do not lead to closing of the control valve and therefore to any undesirable opening of the engine or gas exchange valve in the base circle phase of the cam, always depending on how the valve ball lift and/or the valve spring force of the reverse spring or the freeball element are selected. Element-lengthening base circle eccentricities do not exert any effect on reverse spring or freeball elements, since their control valve is open anyway during the base circle phase. The effect of retarded functioning in opening of the engine or gas exchange valve, as is the case with the conventional hydraulic valve clearance adjusting element described in the introductory part, consequently does not occur with reverse-spring or freeball elements.

According to the invention the desired idle travel, which occurs in these elements, is utilized, for example, to loosen up the cam contact, that is to say to render the contact surfaces of the cam and the reverse-spring or freeball element coming into contact with one another less dimensionally precise, and thereby to reduce the costs. Larger dimensional tolerances in the area of the cam contact do not lead to malfunctioning of the element. Owing to its design construction the control valve of the element remains opened throughout the base circle phase of the cam. The valve clearance adjustment is thereby ensured and the engine or gas exchange valve is not accidentally opened by the greater tolerances in the area of the cam contact. According to the type of valve timing gear selected in each case, other tolerances can also be increased, such as those of a cam roller, the tolerance of the contact surface of a valve push rod, the contact of a bucket tappet where such a tappet is used in the valve train, the contact surface of the lever, such as the rocker arm, or the tolerances of the camshaft bearings.

The camshaft and the camshaft housing, which is formed by the engine block and the cylinder head, can be made less rigid.

In the cam contact radial and axial tolerances can be increased so that element-shortening overall base circle eccentricities can statistically be greater than 35 μm and element-lengthening overall base circle eccentricities can statistically be greater than 38 μm.

The tolerances of the cam roller supported on roller bearings depend on those of the ring, of the needles used as roller elements and of the pin of the roller. The increase in the concentricity tolerance of the cam roller may be greater than 25 μm. It results from the absence of diametric grinding of the ring, the needles and the pin. It is also possible to use rings, needles and pins which are manufactured by non-cutting processes or sintering.

BRIEF DESCRIPTION OF THE DRAWING

A valve clearance adjusting element used according to the invention is represented in the drawing by way of an exemplary embodiment and is described in more detail below, comparing it with a valve timing gear of an internal combustion engine according to the known prior art. In the drawing.

DETAILED DESCRIPTION OF THE DRAWING

Figure 2:
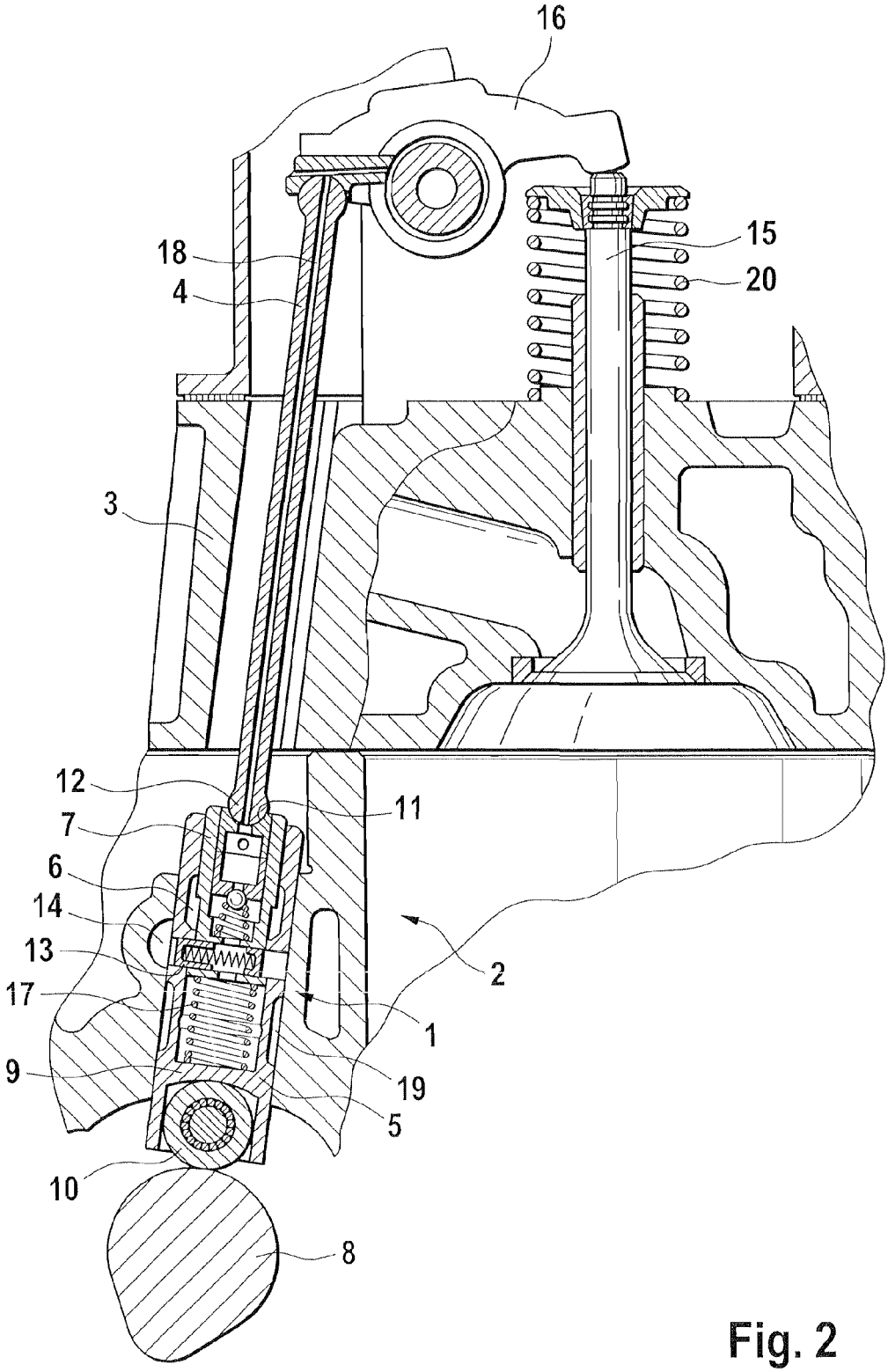
FIG. 2 shows a valve timing gear fitted in an internal combustion engine, with a known valve clearance adjusting element in longitudinal section.

The hydraulic valve clearance adjusting element 1 according to the known prior art, represented in FIG. 2, is fitted in a valve train 2 of an internal combustion engine 3, which can be actuated by way of valve push rods 4. The adjusting element 1 is designed as an adjustable cam follower and comprises an outer cylindrical section 5, which encloses an inner cylindrical section 7 in the interior 6 thereof. Section 7 is axially moveable in relation to section 5.

At one end facing a cam 8 of a camshaft the outer section 5 is closed by a base 9. A roller 10, the circumferential surface of which serves as a lifting face for cam 8, is provided in the area of the base 9. The roller 10 is supported on a pin by way of a roller bearing. In the area of the base 9 said pin is diametrically guided by the outer section 5, where by its ends it is fixed in the outer section 5 by caulking. With its end situated outside the outer section 5 the inner section 7 faces the valve push rod 4, which is here supported by its end 12 on a semispherical bearing face 11 of the inner section 7.

Hydraulic fluid can be fed to an outer end of a control element 13 producing the control action of the adjusting element 1. For this purpose a duct 14 is provided in the internal combustion engine 3. In order to obtain a large lift of a gas exchange valve 15 of the internal combustion engine 3, the valve being connected to the adjusting element 1 by way of a rocker arm 16 and the valve push rod 4, the outer section 5 must be coupled to the inner section 7 of the element 1. The control element 13 is manufactured as a piston-like slide, which is held in the coupling position by a compression spring.

If the gas exchange valve 15 is to be shut off, hydraulic fluid is fed from the duct 14 in front of the outer end face of the control element 13. If the adjusting element 1 is in its base circle phase, in which the outer section 5 and the inner section 7 are not braced in relation to one another, and there is sufficient hydraulic fluid pressure, the control element 13 may be fully displaced radially into the inner section 7 against the force of its compression spring. In the ensuing cam lift the outer section 5 is then displaced relative to the inner section 7 against the force of a compression spring 17 arranged in the outer section 5. The valve push rod 4 and the gas exchange valve 5 are not displaced, because the force of the compression spring 17 of the outer section 5 is less than the counteracting force of the compression spring 20 of the gas exchange valve 15.

As a hydraulically operating valve clearance adjusting element, the adjusting element 1 needs the supply of oil as hydraulic fluid. For this purpose a feed line 18 is arranged in the valve push rod 4. Instead of this feed line, however, a feed line for hydraulic fluid, which in the internal combustion engine 3 leads into the seat 19 for the outer cylindrical section 5, is also feasible.

Figure 1:
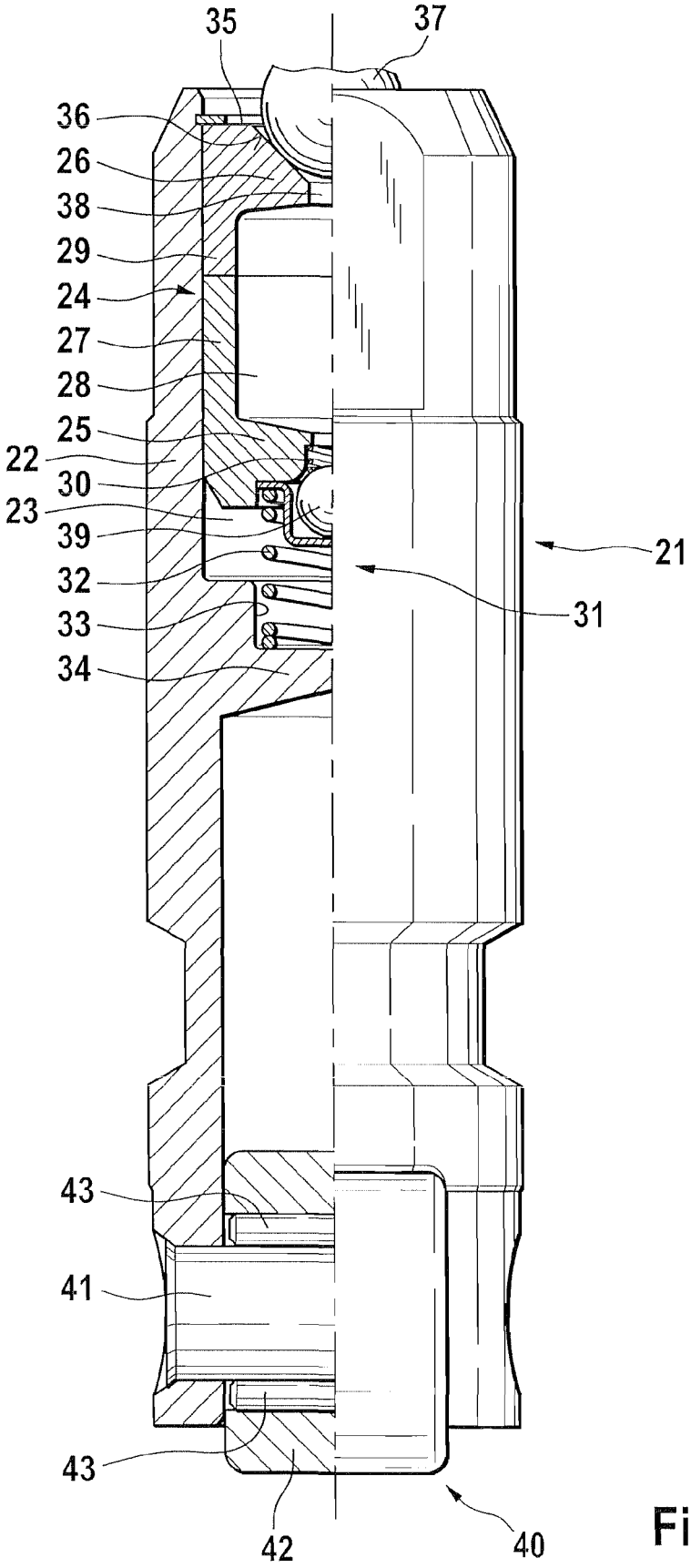
FIG. 1 shows the valve clearance adjusting element used according to the invention, partially in side view and partially in longitudinal section.

The hydraulic valve clearance adjusting element 21 used according to the invention and represented in FIG. 1 has a rotationally symmetrical housing 22, with a roller 40 arranged at the bottom end. The housing 22 has a stepped blind hole, which forms a high-pressure chamber 23 and in which a hollow-cylindrical piston 24 is guided with a tight, sealing clearance. The piston 24 has a lower piston head 25 and an upper piston head 26. It is horizontally divided into a piston lower part 27 and piston upper part 29. Below the lower piston head 25 is the high-pressure chamber 23. Above the lower piston head 25 is a low-pressure chamber 28, which is formed by the interior space of the piston 24 and which serves as an oil reservoir.

The high-pressure chamber 23 is connected to the low-pressure chamber 28 by a central axial bore, which is arranged in the lower piston head 25. It is part of a control valve 31 provided with a control valve spring 30. Said valve extends into the high-pressure chamber 23 below the lower piston head 25. A compression spring 32 is supported in a central recess 33 at the base 34 of the high-pressure chamber 23. It exerts its compressive force on the piston 24. On its outer face 35 the upper piston head 26 has a central conical sunken cavity 36 for guiding the spherical end 37 of a valve push rod (not shown), for example. A further central axial bore 38, which is situated in the upper piston head 26, makes the connection between the lower-pressure chamber 28 and the lubricating oil supply of the valve train. The closing member 39 of the control valve 31 of this adjusting element 21 is a ball. A ring 42 forming the roller 40 is rotatably supported, via the needles 43 of a roller bearing, on a pin 41 fixed to the lower end of the housing 22.

LIST OF REFERENCE NUMERALS

1. Cam follower
2. Valve train
3. Internal combustion engine
4. Valve push rod
5. Outer cylindrical section
6. Interior
7. Inner cylindrical section
8. Cam
9. Base
10. Roller
11. Bearing face
12. End of the valve push rod
13. Control element
14. Duct
15. Gas exchange valve
16. Rocker arm
17. Compression spring
18. Feed line
19. Seat
20. Compression spring
21. Valve clearance adjusting element
22. Housing
23. High-pressure chamber
24. Piston
25. Lower piston head
26. Upper piston head
27. Piston lower part
28. Low-pressure chamber
29. Piston upper part
30. Control valve spring
31. Control valve
32. Compression spring
33. Recess
34. Base
35. Outer face
36. Conical sunken cavity
37. Spherical end
38. Axial bore
39. Closing member
40. Roller
41. Pin
42. Ring
43. Needle

The invention claimed is:

1. A valve timing gear of an internal combustion engine comprising hydraulic valve clearance adjusting elements, in which each of the elements comprises a rotationally symmetrical housing, which is guided so that it is longitudinally displaceable in a seat in the engine and at one axial end of the element is acted upon by a cam of a camshaft, the contact surface of the cam having dimensional tolerances which give rise to a base circle eccentricity in a peripheral direction and which are determined by positive and negative dimensional deviations in the radial dimension of the contact surface, and the element comprising a piston, axially displaceable in the housing, and being non-positively connected by way of this piston or the housing, either directly or via further valve train components provided with contact surfaces, to an engine gas exchange valve, a control valve, which has a closing member and a valve seat for this formed on the piston, being arranged axially between the housing and the piston, wherein a reverse-spring element is used as valve clearance adjusting element, that is to say an element the control valve of which comprises a control valve spring, which is supported by one end on the piston and by the other end on the closing member, and in that the dimensional tolerances of the contact surface of the cam in total exceed 25 μm.

2. Valve timing gear of an internal combustion engine comprising hydraulic valve clearance adjusting elements, in which each of the elements comprises a rotationally symmetrical housing, which is guided so that it is longitudinally displaceable in a seat in the engine and at one axial end of the element is acted upon by a cam of a camshaft, the contact surface of the cam having dimensional tolerances which give rise to a base circle eccentricity in a peripheral direction and which are determined by positive and negative dimensional deviations in the radial dimension of the contact surface, and the element comprising a piston, axially displaceable in the housing, and being non-positively connected by way of this piston or the housing, either directly or via further valve train components provided with contact surfaces, to an engine gas exchange valve, a control valve, which has a closing member and a valve seat for this formed on the piston, being arranged axially between the housing and the piston, wherein a freeball element is used as valve clearance adjusting element, that is to say an element the control valve of which is designed without any control valve spring, and in that the dimensional tolerances of the contact surface of the cam in total exceed 25 μm.

* * * * *